United States Patent [19]

Wang

[11] Patent Number: 5,007,631

[45] Date of Patent: Apr. 16, 1991

[54] STRUCTURE OF CLIMBING EXERCISER WITH A COUNTER-WEIGHT FREEWHEEL MECHANISM

[76] Inventor: Leao Wang, No. 1, Lane 154, Charng Long Rd., Toupienkeng Taiping Hsiang, Taichung Hsien, Taiwan

[21] Appl. No.: 526,590

[22] Filed: May 22, 1990

[51] Int. Cl.[5] ..... A63B 23/04

[52] U.S. Cl. ..... 272/70; 272/96

[58] Field of Search ..... 272/70, 73, 128, 130, 272/131, 132, 96; 128/25 R

[56] References Cited

U.S. PATENT DOCUMENTS

| | | | |
|---|---|---|---|
| 3,970,302 | 7/1976 | McFee | 272/130 |
| 4,533,136 | 8/1985 | Smith et al. | 272/73 |
| 4,564,193 | 1/1986 | Stewart | 272/73 |
| 4,720,093 | 1/1988 | Del Mar | 272/70 |
| 4,838,543 | 6/1989 | Armstrong et al. | 272/70 |
| 4,934,688 | 6/1990 | Lo | 272/130 |

OTHER PUBLICATIONS

Versa Climber-Brochure. 3001 Redhill Ave. Suite 106, Costa Mesa CA92626, Received 3-15-89.

*Primary Examiner*—Stephen R. Crow
*Attorney, Agent, or Firm*—Bacon & Thomas

[57] ABSTRACT

Disclosed is a structure of climbing exerciser, which comprises a freewheel mounted on the frame body thereof and driven to alternatively rotate forward and backward by two driving cords which are connected between the freewheel and two pedals which are mounted on the frame body for pedaling of feet. A retarding belt is mounted on the freewheel with one end secured to the frame body via a spring and with the opposite end connected to a tension regulating device through a steel rope so that the binding force of the retarding belt on the freewheel can be adjusted according to one's condition.

6 Claims, 3 Drawing Sheets

STRUCTURE OF CLIMBING EXERCISER WITH A COUNTER-WEIGHT FREEWHEEL MECHANISM

BACKGROUND OF THE INVENTION

The present invention is related to climbing exercisers and more particularly to a climbing exerciser which incorporates a freewheel to give a counter weight to two pedals thereof and which utilizes a retarding belt controlled by a tension regulating device to adjustably retard the revolution speed of the freewheel so that one can adjust the exerciser according to an exercise level required.

A climbing exerciser is a machine for training the muscles of the hands and feet. In previous, designs a climbing exerciser does not have any counter weight mechanism to increase the exercise level. Recently, a type of climbing exerciser has been developed which is equipped with a hydraulic cylinder to buffer the pedaling so that one must exert more strength to pedal. However, the buffer action of the hydraulic cylinder cannot be properly adjusted according to one's condition.

SUMMARY OF THE INVENTION

The present invention has been developed to alleviate these circumstances. According to a first aspect of the present invention, a climbing exerciser incorporates a freewheel to give a counter weight to the pedals thereof.

According to a second aspect of the present invention, the climbing excerciser has a retarding belt associated with the freewheel, which is secured to the frame body of the device, and controlled by a tension regulating device to adjustably give a freewheel a friction force while the freewheel is driven by the two pedals to alternatively rotate forward and backward.

BRIEF DESCRIPTION OF THE DRAWINGS

The present invention will now be described by way of example with reference to the annexed drawings, in which.

DETAILED DESCRIPTION OF THE PREFERRED EMBODIMENT

Figure 1:
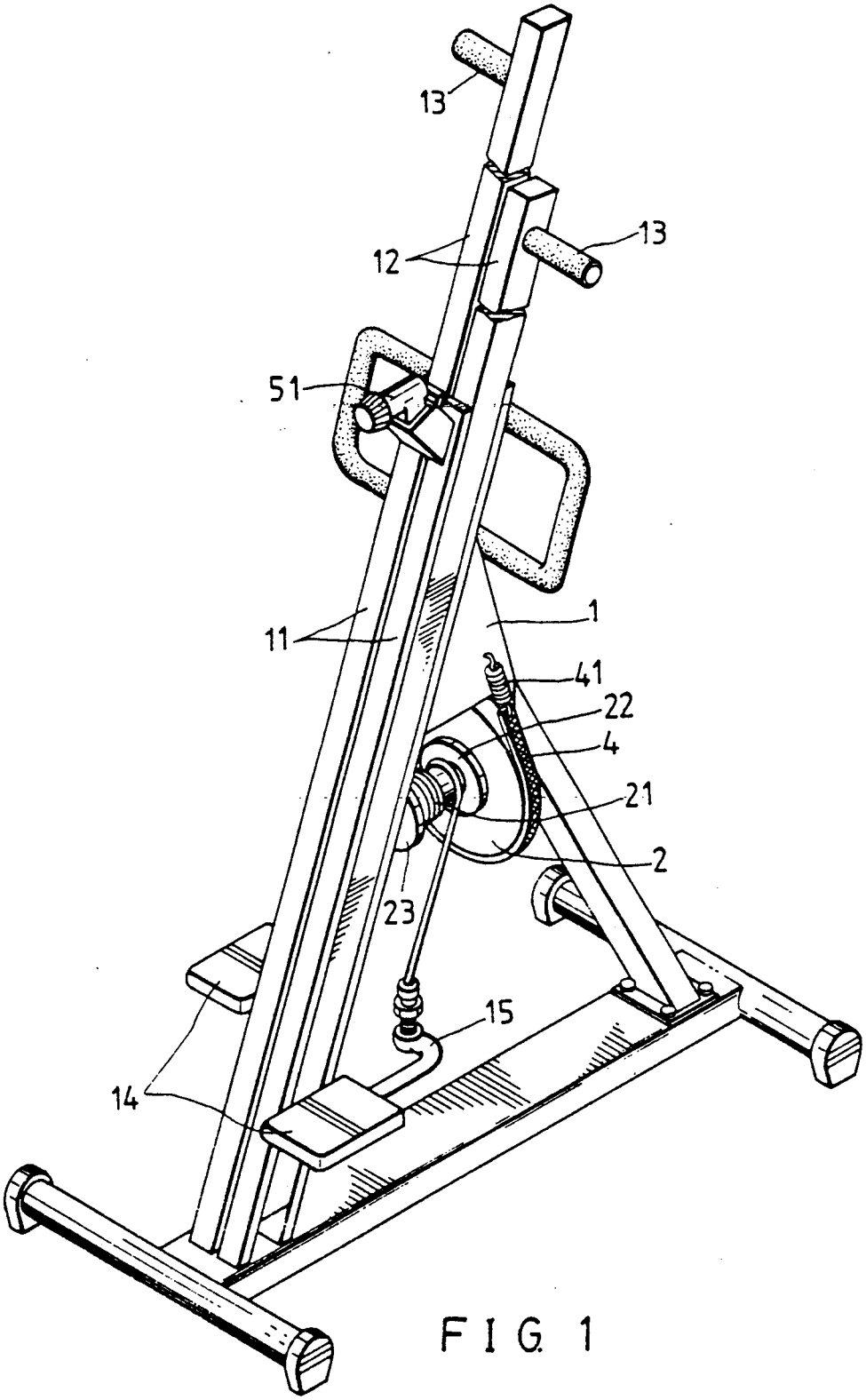
FIG. 1 is a perspective view of a climbing exerciser according to the present invention.
Figure 2:
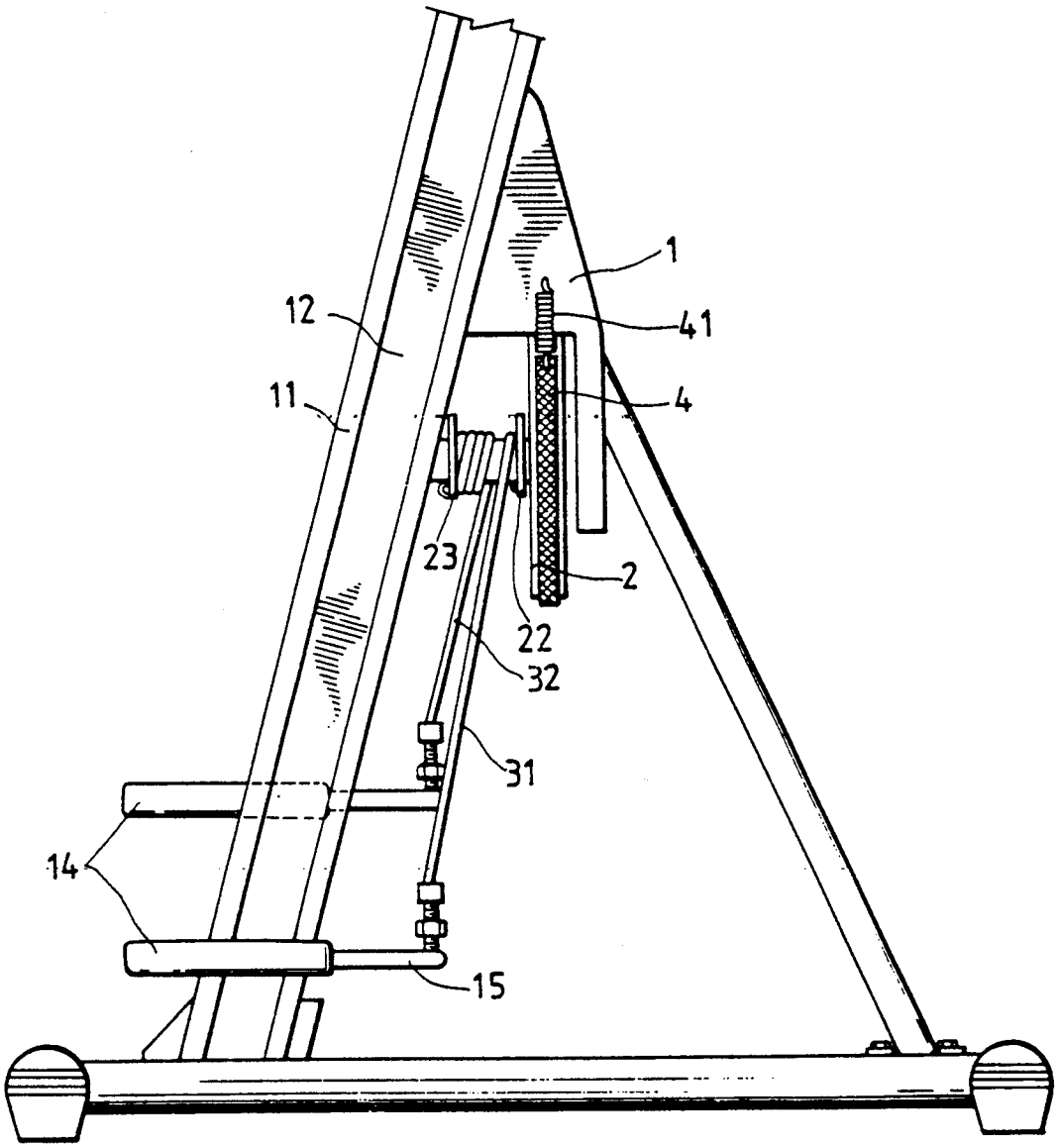
FIG. 2 is a partial side view of the device in FIG. 1.

Referring to FIGS. 1 and 2, a climbing exerciser of the present invention comprises a frame body 1 having two parallel channel bars 11 obliquely set at one side with two sliding rods 12 respectively set to slide therein. The two sliding rods 12 comprise each a transverse handle 13 at an upper position for gripping by a hand and a pedal 14 at a lower position for pedaling by a foot, which pedal 14 is connected with a link 15 at its front end.

A freewheel 2 is secured to the front side of the frame 1 by a shaft 21 and is disposed above the pedals 14. Two plates 22 and 23 are respectively fixed on the shaft 21 to confine two driving cords 31 and 32 which wind on the shaft 21 in counter direction against each other and are respectively secured to one of the two links 15 of the two pedals 14.

When one is holding the two handles 13 with both hands and stepping on the two pedals 14 of the two sliding rods 12 with both feet, the two pedals 14 are pushed to alternatively move up and down. Because the links 15 of the two pedals 14 are respectively connected with the two driving cords 31 and 32 (see FIG. 2), when the first pedal is moved downward to cause the freewheel 2 to rotate in a first (clockwise or counter-clockwise) direction, the first driving cord 31 is let off of the shaft 21 and the second driving cord 32 is taken up on the shaft 21 to lift up the second pedal. As soon as the second pedal is stepped on to move downward, the freewheel 2 is driven to rotate in the opposite (counter-clockwise or clockwise) direction. The second driving cord 32 is let off from the shaft 21 and the first driving cord 31 is taken up on the shaft 21 to lift the first pedal for the next stepping.

As described above, when a pedal is stepped on to move downward, it pulls a driving cord to rotate the freewheel 2. Therefore, more pressure is required to step on the pedals to alternatively rotate the freewheel forward and backward, i.e. one can more efficiently achieve a required exercise level.

Figure 3:
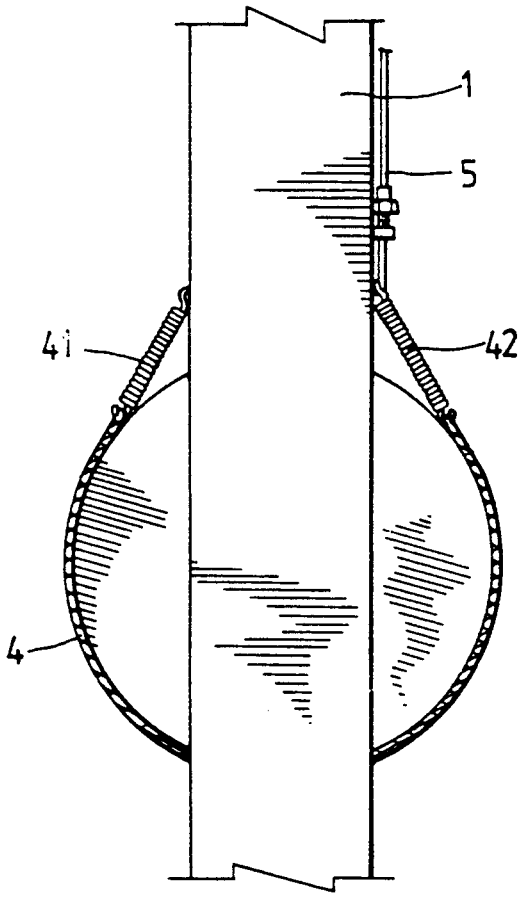
FIG. 3 is a partial front view of the device in FIG. 1.

Another feature of the present invention is the use of a retarding device to adjust the pressure required for moving the pedals 14 downward. As shown in FIG. 3, a retarding belt 4 is associated with the freewheel 2 with its ends respectively secured to springs 41 and 42. The the first spring 41 is secured to the frame body 1 and the second spring 42 is coupled with a steel rope 5. By means of a known regulating device 51 which is mounted on the frame body 1 and connected with the steel rope 5, the pull force of the steel rope 5 on the springs 41 and 42 can be flexibly adjusted so as to change the resistance force between the retarding belt 4 and the freewheel 2. Thus, by means of the control of the regulating device 51, the pull force of the rotating cords 31 and 32 for driving the freewheel 2 can be adjusted. In order to secure the position of the retarding belt 4 on the periphery of the freewheel 2, the freewheel 2 is designed to have a grooved rim so that the retarding belt 4 can be firmly mounted thereon.

As described above, the present invention is to provide a climbing exerciser which comprises a freewheel on the frame body thereof and alternatively rotate forward and backward by two driving cords through two pedals so as to give a counter weight to the pedals while pedalling. A retarding belt, associated with such a freewheel is controlled by a regulating device through two springs to produce a variable resistance force on the freewheel while it is rotated by the pedals.

I claim:

1. A climbing exerciser comprising:

(a) a generally vertical frame body (b) first and second pedals each slidably attached to a lower portion of the frame body so as to move along a predetermined path of travel;

(c) first and second handles adapted to be gripped by the user;

(d) connecting means comprising a first rod slidably attached to the frame body and having the first handle and first pedal attached thereto; and, a second rod slidably attached to the frame body and having the second handle and second pedal attached thereto for connecting the first handle to the first pedal and the second handle to the second pedal such that movement of each pedal causes similar movement of each associated handle;

(e) a freewheel rotatably attached to the frame body; and, (f) drive means interconnecting each pedal and the freewheel such that downward movement of each pedal along its path of travel causes rotation of the freewheel.

2. The climbing exerciser of claim 1 wherein the drive means comprises:

(a) a shaft attached to the freewheel so as to rotate therewith;

(b) a first driving cord having a first end attached to the first pedal and a second end attached to the shaft; and, (c) a second driving cord having a first end attached to the second pedal and a second end attached to the shaft;

wherein alternate downward movement of the pedals causes the shaft and freewheel to rotate in the alternate directions.

3. The climbing exerciser of claim 2 further comprising retarding means operatively associated with the freewheel to exert a retarding force on the pedals.

4. The climbing exerciser of claim 3 wherein the retarding means comprises:

(a) a retarding belt; and, (b) attaching means to attach ends of the belt to the frame body such that at least a portion of the retarding belt frictionally contacts at least a portion of the periphery of the freewheel.

5. The climbing exerciser of claim 4 further comprising adjustable means attaching a first end of the retarding belt to the frame body such that the retarding force exerted on the freewheel may be varied.

6. The climbing exerciser of claim 4 wherein a peripheral rim of the freewheel defines a groove to accommodate the retarding belt.

* * * * *